US007936896B2

(12) United States Patent
Horigome et al.

(10) Patent No.: US 7,936,896 B2
(45) Date of Patent: May 3, 2011

(54) SPEAKER APPARATUS

(75) Inventors: Minoru Horigome, Tendo (JP); Teruaki Kaiya, Tendo (JP); Yuichi Takahashi, Tendo (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 1210 days.

(21) Appl. No.: 11/594,768

(22) Filed: Nov. 9, 2006

(65) Prior Publication Data

US 2007/0116322 A1 May 24, 2007

(30) Foreign Application Priority Data

Nov. 11, 2005 (JP) ..... P2005-326983

(51) Int. Cl.
*H04R 1/00* (2006.01)
*H04R 9/06* (2006.01)
*H04R 11/02* (2006.01)

(52) U.S. Cl. ..... 381/397; 381/396; 361/690

(58) Field of Classification Search ..... 381/397, 381/396; 361/690

See application file for complete search history.

(56) References Cited

U.S. PATENT DOCUMENTS

| | | | | |
|---|---|---|---|---|
| 1,948,361 | A | 2/1934 | Sollie | |
| 5,991,424 | A | 11/1999 | Bertagni et al. | |
| 2003/0081808 | A1 * | 5/2003 | Kemmerer | 381/397 |

FOREIGN PATENT DOCUMENTS

| | | | |
|---|---|---|---|
| EP | 1549107 | A2 | 6/2005 |
| JP | 2002-218588 | A | 8/2002 |
| JP | 2003-299185 | A | 10/2003 |
| JP | 2005-191746 | A | 7/2005 |

OTHER PUBLICATIONS

Notification of Reasons for Refusal dated May 25, 2010, issued in counterpart Japanese Application No. 2005-326983.

* cited by examiner

*Primary Examiner* — Curtis Kuntz
*Assistant Examiner* — Matthew Eason
(74) *Attorney, Agent, or Firm* — Sughrue Mion, PLLC

(57) ABSTRACT

According to an aspect of the invention, there is provided a speaker apparatus including: a magnetic circuit; a vibrating plate vibrated by the magnetic circuit; a speaker frame holding the magnetic circuit and the vibrating plate, and a connecting portion connecting a portion of holding the vibrating plate and a portion of holding the magnetic circuit, an inclined face of the connecting portion being inclined relative to a direction of tangential line of circumference of the speaker frame, the connecting portion configured to flow air due to a vibration of the vibrating plate along the inclined face thereof.

6 Claims, 7 Drawing Sheets

SPEAKER APPARATUS

CROSS-REFERENCE TO RELATED APPLICATIONS

This application is based on and claims the benefit of priority from the prior Japanese Patent Application No. 2005-326983, filed on Nov. 11, 2005; the entire contents of which are incorporated herein by reference.

BACKGROUND

1. Technical Field

The present invention relates to a speaker apparatus.

2. Related Art

FIG. 1 shows a constitution of a related-art general dynamic speaker apparatus.

The speaker apparatus 1 includes; a magnetic circuit 3; a frame 5 attached with the magnetic circuit 3 at a rear portion thereof; a vibrating plate 9 of a cone-like shape in which an edge 7 in a roll-like shape at an outer periphery thereof is fixed to a vibrating plate supporting portion 5*a* of a front portion of the frame 5, and a voice coil 12 wound around a voice coil bobbin 11 in a cylindrical shape.

The magnetic circuit 3 includes a yoke 15 projecting a center pole 15*b* in a cylindrical shape at a center of a plate 15*a* in a shape of a circular plate, a magnet 16 in a ring-like shape fitted to an outer periphery of the center pole 15*b*, and a top plate 17 in a ring-like shape fitted to be mounted to a front end side of the center pole 15*b* to interpose the magnet 16 between the top plate 17 and the plate 15*a*.

A gap between an inner periphery of the top plate 17 and the center pole 15*b* serves as a magnetic gap 19 for arranging the voice coil 12.

The vibrating plate 9 is formed with an opening portion 9*a* for inserting the voice coil bobbin 11 at a center thereof. The edge 7 bonded to an outer peripheral edge of the vibrating plate 9 is fixed to the vibrating plate supporting portion 5*a*. An attaching flange 7*a* mounted to an outer periphery of the edge 7 is interposed between a gasket 21 in a ring-like shape pasted to the vibrating plate supporting portion 5*a* and the vibrating plate supporting portion 5*a*.

Further, an inner peripheral portion 9*b* of the vibrating plate 9 forming the opening portion 9*a* is fixed to an outer periphery of the voice coil bobbin 11 inserted to the opening portion 9*a* by adhering or the like.

Further, a center portion of the vibrating plate 9 is pasted with a dust cap 28. The dust cap 28 covers a front side of the voice coil bobbin 11 to prevent dust and dirt from invading the magnetic gap 19.

The voice coil bobbin 11 in the cylindrical shape is fitted to an outer periphery of the center pole 15*b* movably in an axial direction and is elastically supported by the frame 5 by a damper 25 to restrict movement thereof in the axial direction.

Normally, there is spread the damper 25 forming a bellows structure concentrically with the voice coil bobbin 11.

The damper 25 damps the vibrating plate 9 by restricting displacement of the voice coil bobbin 11 in a radius direction by fixing an outer peripheral edge thereof to a damper supporting portion 5*b* of the frame 5 and fixing an inner peripheral portion thereof to an outer periphery of the voice coil bobbin 11 and absorbing vibration energy by deforming the bellows in driving the vibrating plate 9.

The frame 5 is normally configured by a structure of providing a plurality of frame openings 5*c* formed at pertinent intervals along a circumferential direction of the speaker between the vibrating plate supporting portion 5*a* and the damper supporting portion 5*b*. The frame opening 5*c* functions as a vent hole for releasing an air flow produced by a back pressure in driving the vibrating plate 9.

Further, the frame opening 5*c* not only functions as the above-described vent hole but also constitutes light-weighted formation of the frame 5.

When a sound signal is inputted to the voice coil 12, the above-described speaker apparatus 1 reproduces sound by vibrating the vibrating plate 9 by reciprocally vibrating the voice coil bobbin 11 thereby.

Recently, examples of employing a large-sized speaker for reproducing low frequency sound, such as subwoofer, are increasing in a car-audio system.

When the large-sized speaker apparatus is designed for the car-audio system, a depth dimension of a portion utilized as a cabinet of the speaker apparatus such as a vehicle-mounted speaker cabinet or an inner side of a vehicle door is limited and therefore, it may be subject to thin the speaker apparatus.

However, according to the related-art speaker apparatus 1 in which the voice coil bobbin 11 is elastically supported by the damper 25 as described above, a space of arranging the damper 25 needs to provide between the vibrating plate 9 and the magnetic circuit 3. It is difficult to shorten a dimension in the axial direction of the speaker apparatus in order to provide the space of installing the damper 25.

Further, a stiffness of the damper 25 is normally larger than that of the edge 7 and therefore, mechanical fatigue by a long period of time of use is brought about earlier than in the edge 7 and there is a concern of causing a failure by deteriorating a control function.

Further, there is also a possibility of generating particular vibration or a brazing sound by deforming the bellows in propagating vibration between the contiguous bellows on the damper 25, which conversely effects an influence on the vibration of the voice coil 12 or the vibrating plate 9 to deteriorate sound quality. (refer to, for example, JP-A-2005-191746).

Further, it is a problem for the speaker apparatus how to cool heat generated by the magnetic circuit particularly by narrowing the installing space by thinning the speaker apparatus. A number of proposals have been made for cooling speaker apparatus (refer to, for example, JP-A-2003-299185).

SUMMARY

However, the inner side of the speaker cabinet or the inner side of the vehicle door does not allow to be attached with the thinned speaker apparatus. A space at a back face of the attached speaker apparatus is narrowed. Therefore, it is difficult to smoothly move an air flow by the back pressure in driving the vibrating plate. Sound quality of the speaker is deteriorated. Further, when movement of the air flow is deteriorated, heat generated by the magnetic circuit of the speaker is hampered from being exhausted.

On the other hand, when the vent hole for making the air flow smooth is enlarged, a strength of the speaker frame is reduced. Therefore, it is difficult to hold the magnetic circuit.

The present invention has been made in view of the above circumstances and provides a speaker apparatus. According to an aspect of the invention, the problem that the air flow due to the back pressure in driving the vibrating plate is not moved smoothly in the related-art speaker apparatus can be solved without a reduction in the strength of the speaker frame.

According to an aspect of the invention, there is provided a speaker apparatus including: a magnetic circuit; a vibrating plate vibrated by the magnetic circuit; a speaker frame holding the magnetic circuit and the vibrating plate, and a connecting portion connecting a portion of holding the vibrating plate and a portion of holding the magnetic circuit, an inclined face of the connecting portion being inclined relative to a direction of tangential line of circumference of the speaker frame, the connecting portion configured to flow an air due to a vibration of the vibrating plate along the inclined face thereof.

DESCRIPTION OF THE EMBODIMENTS

According to embodiments of the invention, in the thinned speaker apparatus, the problem that the air flow by the back pressure in driving the vibrating plate is not moved smoothly can be resolved without being accompanied by a reduction in the strength of the speaker frame.

The air flow by the back pressure in driving the vibrating plate can be made to move smoothly and sound quality of the speaker apparatus can be prevented from being deteriorated. Further, by making the air flow move smoothly, heat generated by the magnetic circuit of the speaker apparatus can efficiently be exhausted and therefore, an effect of cooling the magnetic circuit can be promoted.

Embodiments of the present invention will be described hereinbelow by reference to the drawings.

First Embodiment

Figure 1:
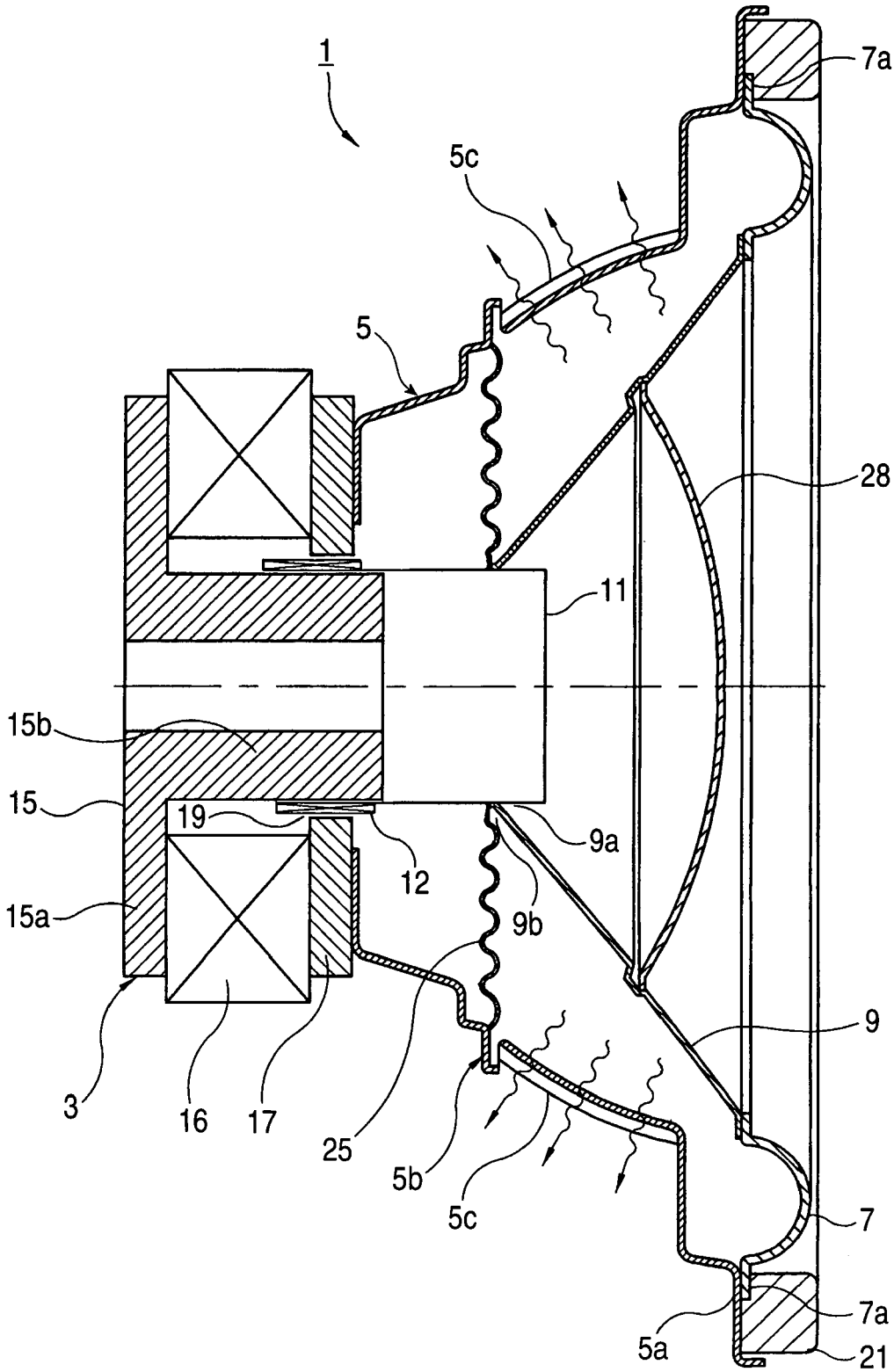
FIG. 1 is a vertical sectional view showing a related-art speaker apparatus.
Figure 2:
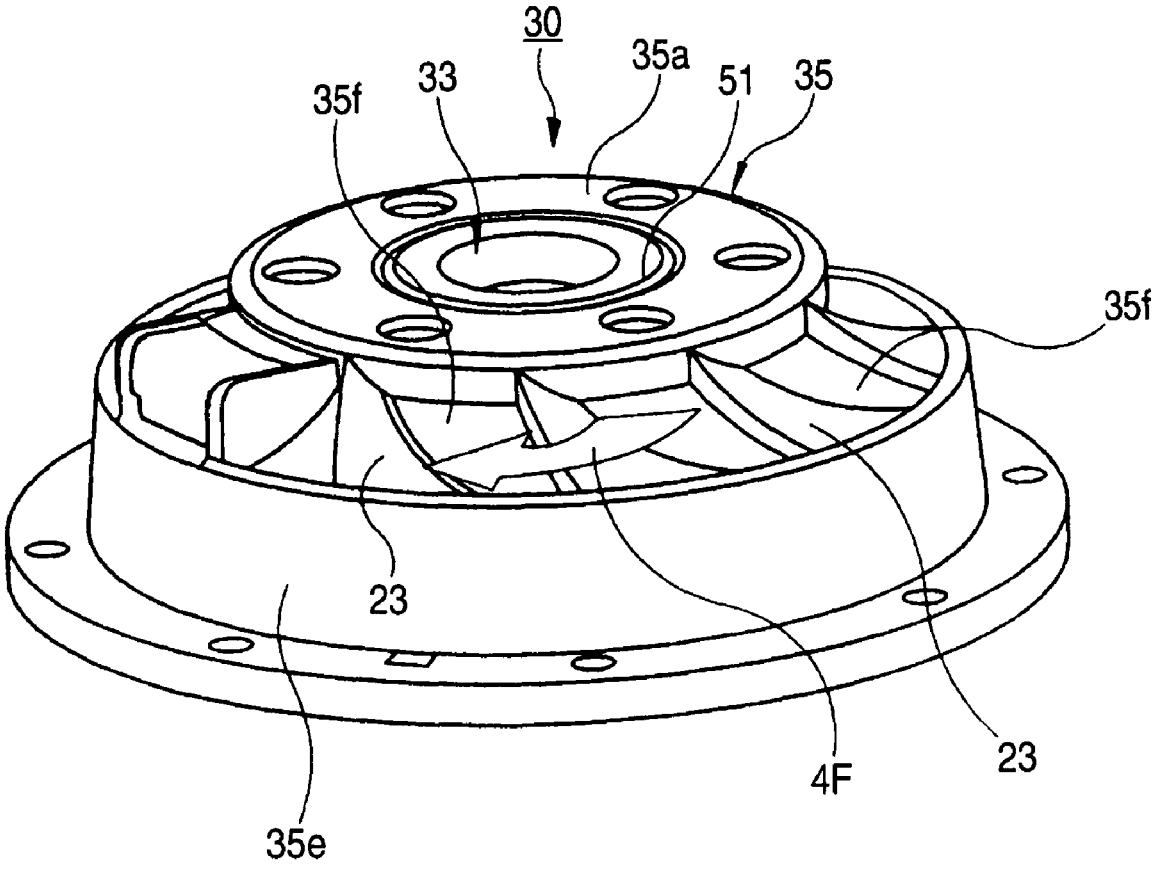
FIG. 2 is a perspective view of a speaker according to a first embodiment of the invention.
Figure 3:
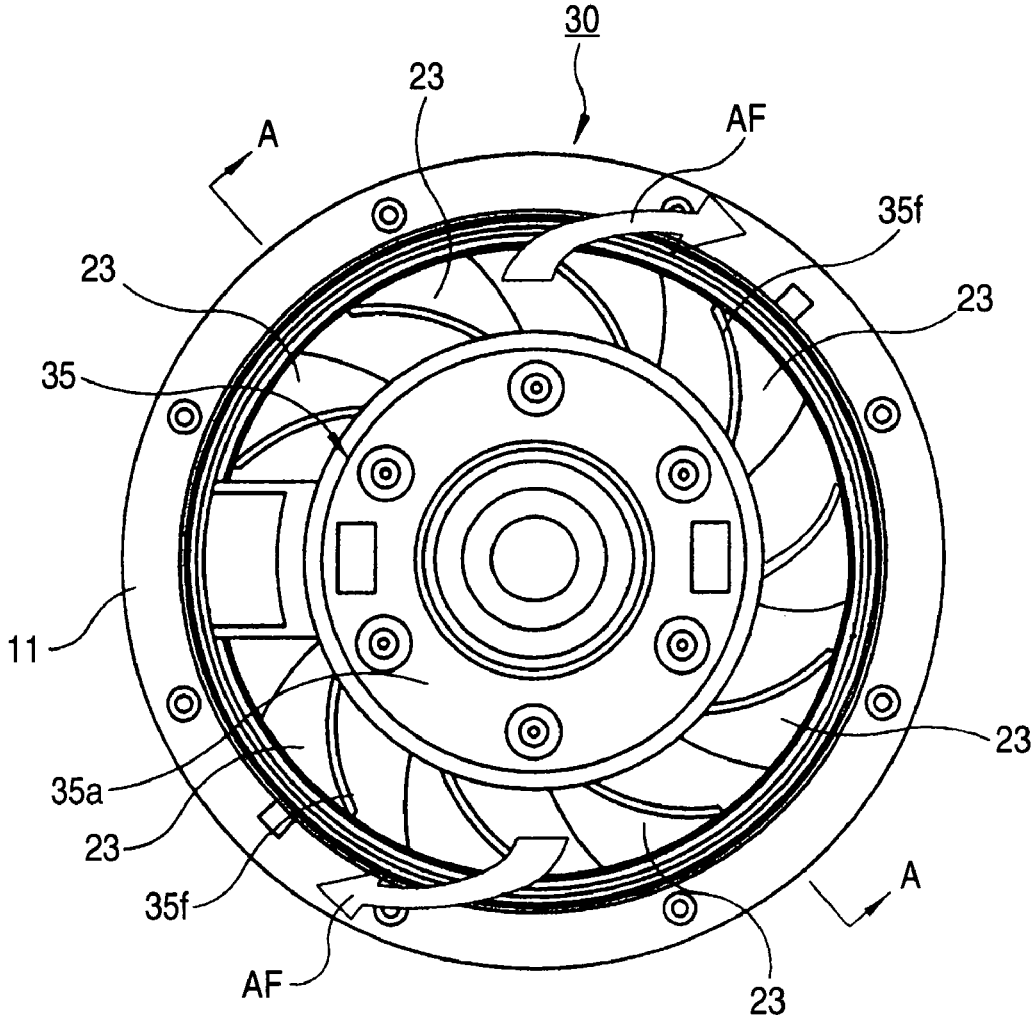
FIG. 3 is a plane view of the speaker apparatus according to the first embodiment.
Figure 4:
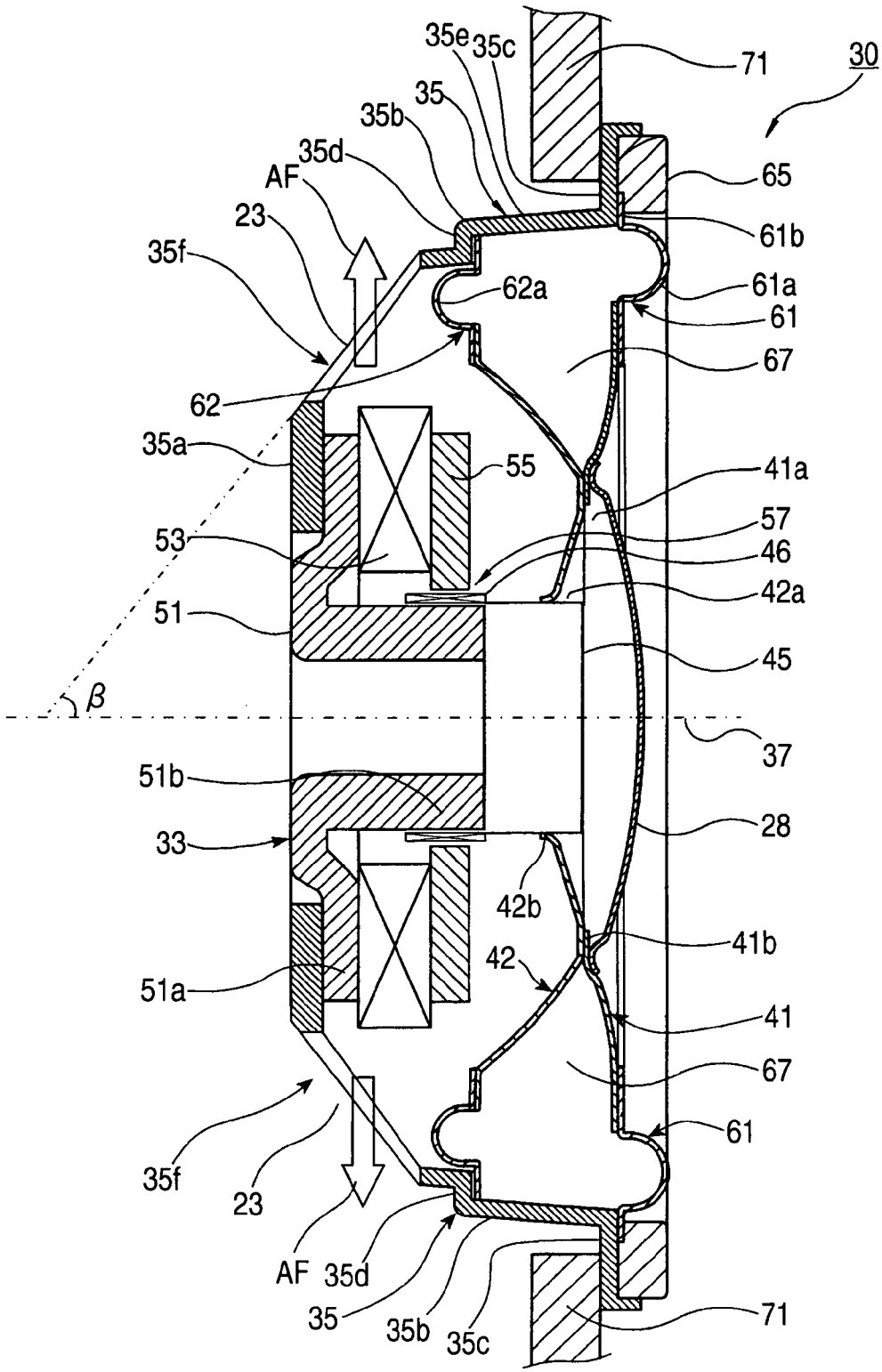
FIG. 4 is a vertical sectional view taken along a line A-A of FIG. 3.
Figure 5:
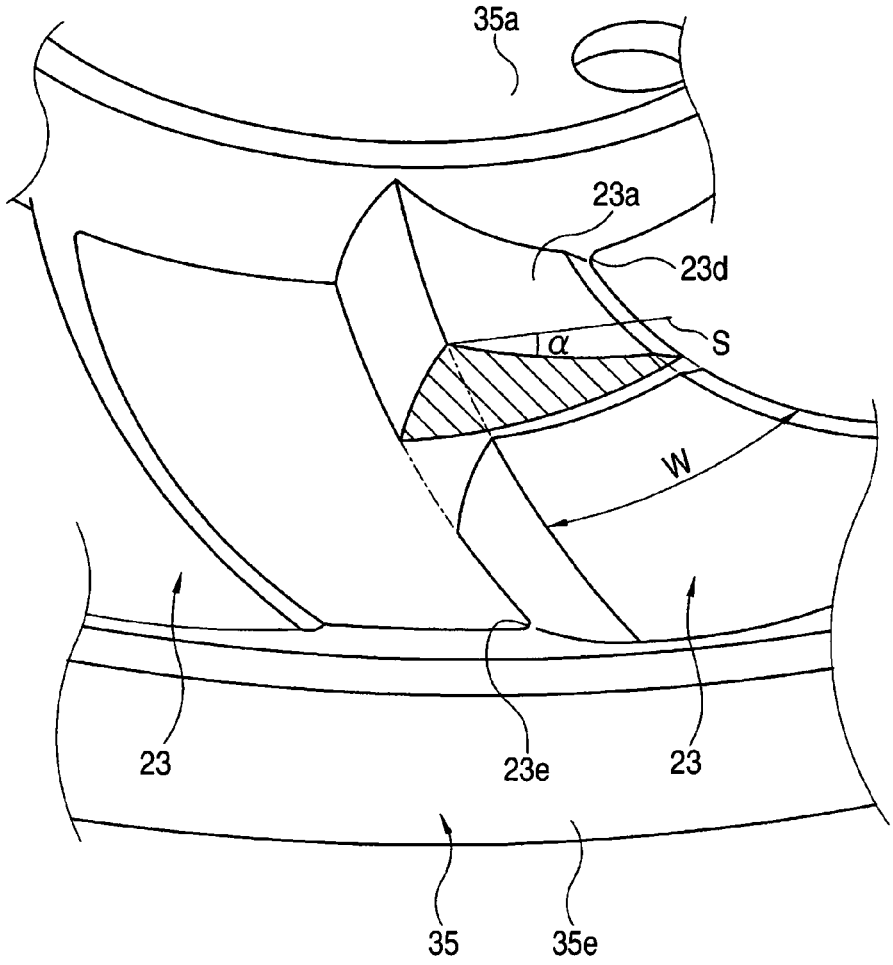
FIG. 5 is a perspective view enlarging a main portion of the speaker apparatus according to the first embodiment.
Figure 6:
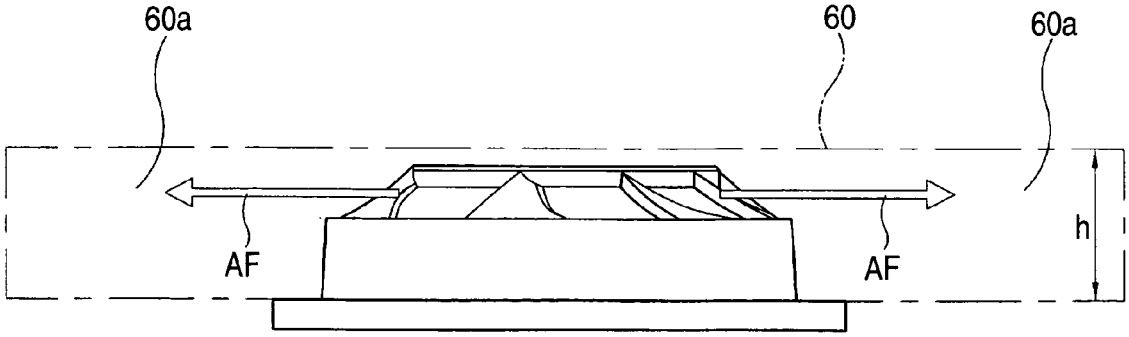
FIG. 6 is an outline side view showing a state of mounting the speaker apparatus according to the first embodiment to a cabinet.

FIG. 2 is a perspective view of a speaker apparatus according to a first embodiment of the invention. FIG. 3 is a plane view of the speaker apparatus according to the first embodiment. FIG. 4 is a vertical sectional view of the speaker apparatus according to the first embodiment. FIG. 5 is a perspective view enlarging a main portion of the speaker apparatus according to the first embodiment. FIG. 6 is an outline side view showing a state of mounting the speaker apparatus according to the first embodiment to a cabinet.

As shown by FIGS. 2, 3 and 4, a speaker apparatus 30 has substantially in a concentric shape centering on a speaker center line 37. The speaker apparatus 30 includes; a magnetic circuit 33; a speaker frame 35 attached with the magnetic circuit 33 at a rear portion thereof; a vibrating plate 41 and a drive member 42 (hereinafter, referred to as drive cone) coaxially arranged in a direction of driving the speaker; and a voice coil 46 wound around a voice coil bobbin 45 in a cylindrical shape.

The magnetic circuit 33 is configured by a yoke 51 having a structure of projecting a center pole 51*b* in a cylindrical shape at a center of a plate 51*a* in a shape of a circular plate, a magnet 53 in a ring-like shape fitted to an outer periphery of the center pole 51*b*, and a top plate 55 in a ring-like shape fitted to a front end side of the center pole 51*b* to interpose the magnet 53 between the top plate 55 and the plate 51*a*. A gap between an inner periphery of the top plate 55 and the center pole 51*b* constitutes a magnetic gap 57 of arranging the voice coil 46.

The speaker frame 35 has a substantially bowl shape and has a shallow bottom. An inner face of a bottom plate portion 35*a* is pertinently attached with the magnetic circuit 33 in a state of mounting the plate 51*a* of the yoke 51. The speaker frame 35 is respectively provided with a vibrating plate supporting portion 35*c* of the vibrating plate 41 and a vibrating plate supporting portion 35*d* of the drive cone 42 at positions apart from each other along the direction of driving the speaker.

A peripheral wall 35*b* between the two vibrating plate supporting portions 35*c*, 35*d* is configured by a hermetically closed wall in which openings are not provided. On the other hand, the vibrating plate supporting portions 35*c*, 35*d* and the bottom plate portion 35*a* for holding the magnetic circuit 33 are pertinently connected by a connecting portion 23. The connecting portion 23 has a plurality of pieces of openings 35*f* at pertinent intervals along a circumferential direction of the speaker.

The opening 35*f* is an opening through which an air flow AF produced by a back pressure of the vibrating plate (an arrow mark indicating the air flow AF in the illustration designates a direction thereof in exhausting) passes and serves as a vent hole for escaping the back pressure. A back face of the vibrating plate supporting portion 35*c* of the speaker frame 35 serves as a flange face hermetically fixed to a baffle 71 of a speaker cabinet 60.

The vibrating plate 41 and the drive cone 42 are vibrating plates of a cone type, edges 61, 62. The vibrating plate 41 and the drive cone 42 are fixed to the vibrating plate supporting portions 35*c*, 35*d* on the speaker frame 35 at outer peripheral portions thereof. The vibrating plate 41 and the drive cone 42 are bonded to be fixed to the voice coil bobbin 45 at inner peripheral portions 41*b*, 42*b*.

It may be to use a member of a material having high inner loss for the edges 61, 62 in order to attenuate vibration propagated from cone paper (corresponding to a main body of the vibrating plate). Therefore, the edges 61, 62 may be configured by bonding, for example, members of a material different from that of cone paper (material having inner loss higher than that of cone paper).

According to the vibrating plate 41 arranged on a front face side of the speaker apparatus 30, a diameter of an opening of a center portion thereof is set to be larger than a diameter of an opening of the drive cone 42 arranged on the front face side of the speaker apparatus 30, and the edge 61 is provided with a bulged portion 61*a* bulged to an outer side of a hermetically closed space 67 between the vibrating plates (front face side of the speaker apparatus).

Further, according to the drive cone 42 arranged at a back portion of the vibrating plate 41, the diameter of the opening of the center portion is set to be substantially equal to an outer diameter of the voice coil bobbin 45, and the edge 62 is provided with a bulged portion 62*a* bulged to an outer side of the hermetically closed space 67 between the vibrating plates (back face side of the speaker apparatus). Further, directions of recesses and projections of the bulged portion 61*a* and the bulged portion 62*a* are not limited to directions as shown by FIG. 4.

The respective edges 61, 62 of the vibrating plate 41 and the drive cone 42 are respectively fixed to the two vibrating plate supporting portions 35*c*, 35*d* of the speaker frame 35 mentioned above.

An attaching flange portion 61*b* continuously provided to an outer peripheral portion of the edge 61 of the vibrating plate 41 is pinched by a gasket 65 and the vibrating plate supporting portion 35*c* to be fixed to the vibrating plate supporting portion 35*c*.

The inner peripheral portion 41*b* of the vibrating plate 41*b* is bonded to the drive cone 42 in a state of being overlapped on the drive cone 42 disposed on a back side thereof.

A dust cap 28 is pasted to be mounted to a center portion of the vibrating plate 41. The dust cap 28 covers a front side of the voice coil bobbin 45 to prevent dust and dirt or the like from invading the magnetic gap 57.

The inner peripheral portions 41*b*, 42*b* of the vibrating plate 41 and the drive cone 42 are to be fixed to the voice coil bobbin 45 by adhering to fix the inner peripheral portion 42*b* of the drive cone 42 to an outer periphery of the voice coil bobbin 45 by a pertinent adhesive.

The voice coil bobbin 45 in the cylindrical shape is fitted to an outer periphery of the center pole 51*b* movably in an axial direction and is positioned in a radius direction and in the axial direction by the drive cone 42 bonded to an outer periphery thereof.

The space 67 between the vibrating plates surrounded by the vibrating plate 41 and the drive cone 42 and the speaker frame 35 is hermetically closed.

When the vibrating plate 41 and the drive cone 42 are driven by displacing the voice coil bobbin 45 in the axial direction, as shown by FIG. 4, a gas of air or the like sealed in the hermetically closed space 67 between the vibrating plates is compressed by displacing the vibrating plate 41 and the drive cone 42 and displacing the edges 61*a*, 62*a* to achieve spring performance as an air spring, and the voice coil bobbin 45 is controllably supported.

It is not necessary to mount a damper for elastically supporting the voice coil bobbin 45 on the back side of the vibrating plate 41 and the drive cone 42. A speaker apparatus 30 can apply to a vehicle-mounted audio system or the like by shortening a dimension in the axial direction thereof by omitting a damper and a space of installing the damper.

Explaining the above-described connecting portion 23 in details, as shown by FIG. 5, the connecting portion 23 includes an inclined face 23*a* having an inclination angle α relative to a tangential line direction S of a circumference of the speaker frame 35. The angle of inclination α may be in a range equal to or smaller than 60 degrees. A plurality of the connecting portions 23 has a substantially plate-like shape and directions of inclining the inclined faces 23*a* are constituted to be substantially the same.

The connecting portion 23 may be with an angle of inclination of 30 degrees through 90 degrees as an angle of inclination β in an axial direction of the speaker relative to the speaker center line 37.

By constituting the connecting portion 23 in this way, the air flow AF coming out from the opening 35*f* (air flow going to the opening 35*f* in a direction reverse to the arrow mark of the illustration) is moved along the direction of inclining the inclined face 23*a* of the connecting portion 23.

Further, by constituting corner portions 23*d*, 23*e* of the connecting portion 23 by comparatively large R faces, a strength of the connecting portion 23 can be increased, or a strength of a die can be prevented from being reduced.

The connecting portion 23 is configured by narrowing a width W thereof gradually in a direction of the magnetic circuit 33 and is configured by gradually changing the angle of inclination α in the direction. The configuration of the connecting portion is similar to respective blowing fins of a well-known fan, for example, as shown by FIG. 5, a shape of a cross-sectional face of the connecting portion 23 is configured by substantially a wedge-like shape of thinning a side thereof proximate to the vibrating plate 41. A resistance of air of the connecting portion 23 particularly when air is exhausted to outside of the speaker apparatus is reduced and the air flow AF flows smoothly.

The air flow AF produced by vibrating the vibrating plate 41 and the drive cone 42 constitutes the air flow AF in a direction of a vortex flow centering on the speaker center line 37 along the inclined face 23*a* of the connecting portion 23. Further, the air flow AF constitutes a flow along a direction (direction of speaker plane) substantially orthogonal to the speaker center line 37.

Since the air flow AF flows to diverge in a direction of the side face of the speaker apparatus 30 in this way, a space on a side of a side face of the speaker apparatus 30 (refer to FIG. 6) can effectively be utilized and the air flow becomes active, and heat generated by the magnetic circuit 33 can effectively be cooled.

Further, different from the case of the damper having the bellows structure in which the deformation is moved between the contiguous bellows (recessed and projected portions) in propagating the vibration, the vibrating plate 41 and the drive cone 42 are not considerably deformed locally, in addition thereto, the back pressure can effectively be released even by the cabinet which is narrow in the direction of the speaker center line 37 and therefore, high quality reproduction of sound without unclear sound can be realized.

According to the first embodiment, as shown by FIG. 6, in a case of being mounted to the thinned cabinet 60, the air flow AF by the back pressure produced by the drive cone 42 flows in the direction substantially orthogonal to the speaker center line 37, such that the air flow AF is diverged in the direction of the side face of the speaker apparatus 30 and therefore, the air flow AF is diverged in a direction of a vortex flow as described above (direction orthogonal to speaker as shown by FIG. 6 when viewed from side face direction).

Therefore, even in the case of the thinned cabinet 60 as shown by FIG. 6, a space 60*a* in the direction of the side face of the cabinet which is easy to be provided comparatively can effectively be utilized. As a result, according to the speaker apparatus 30, even when the speaker apparatus is applied to the cabinet 60 having the narrow depth dimension on the side of the back face of the speaker, in other words, the thinned cabinet 60, the back pressure can effectively be controlled and reproduced sound quality can be promoted.

Further, also in an operation of cooling the magnetic circuit 33, effective cooling utilizing the shape of the thinned cabinet 60 effectively can be carried out.

Second Embodiment

Figure 7:
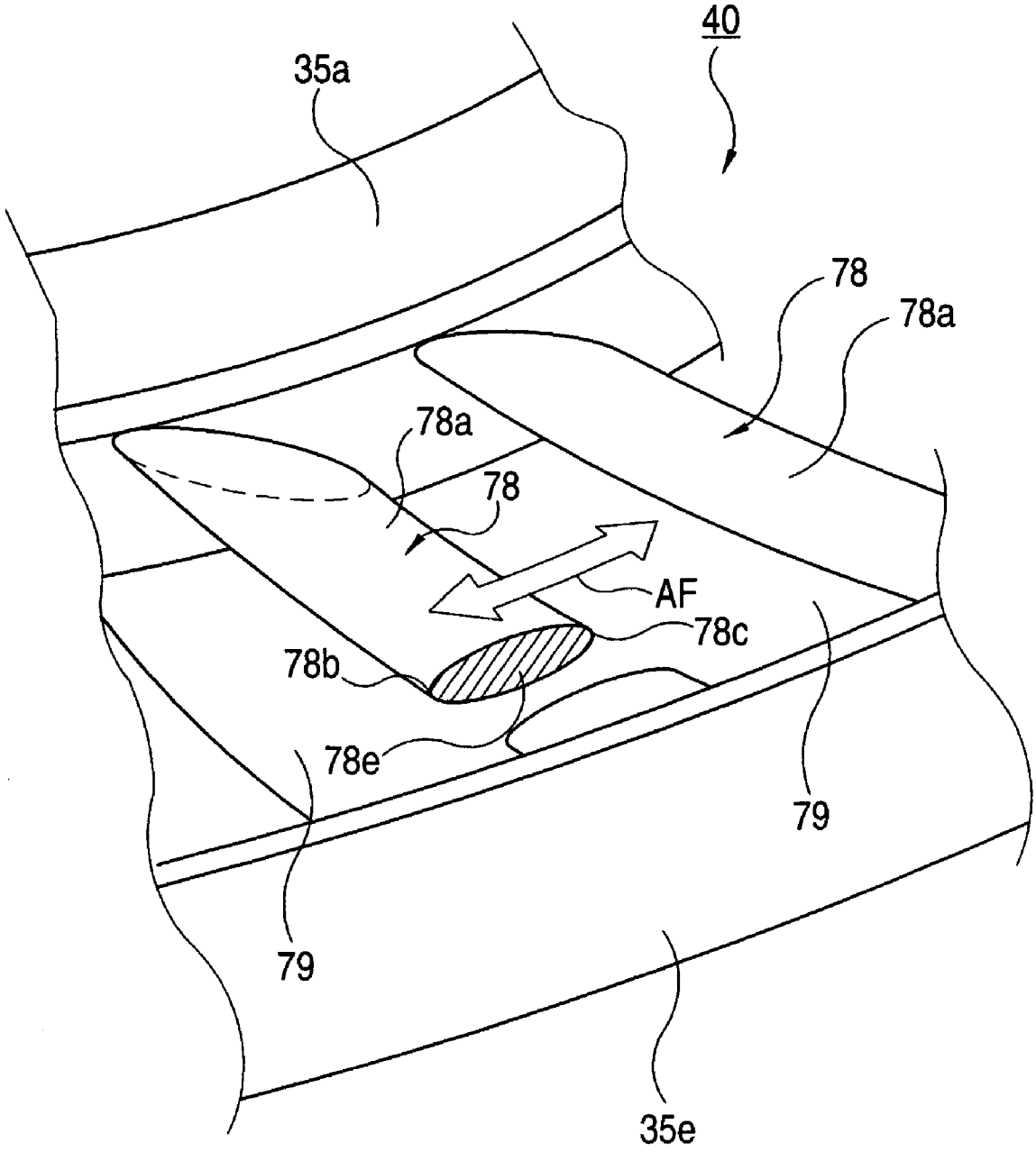
FIG. 7 is a partial perspective view of a main portion of a speaker apparatus according to a second embodiment of the invention.

FIG. 7 is a perspective view of a main portion of a speaker apparatus according to a second embodiment of the invention.

According to a speaker apparatus 40 of the second embodiment, as shown by FIG. 7, in a shape of a cross-sectional face of a connecting portion 78, a center portion 78*e* is configured by a thick wall, both end sides 78*b*, 78*c* are configured by a thin-walled streamline shape in the speaker apparatus 30 of the first embodiment shown by FIG. 2 and FIG. 3.

Both front-side and back side faces of the inclined face 78*a* of the connecting portion 78 are configured by a streamline shape and therefore, a resistance of air of the connecting portion 78 when air is exhausted to outside of the speaker and when air flows thereto can be reduced and the flow of the air flow AF passing an opening 79 can be made to be smoother.

Third Embodiment

Figure 8:
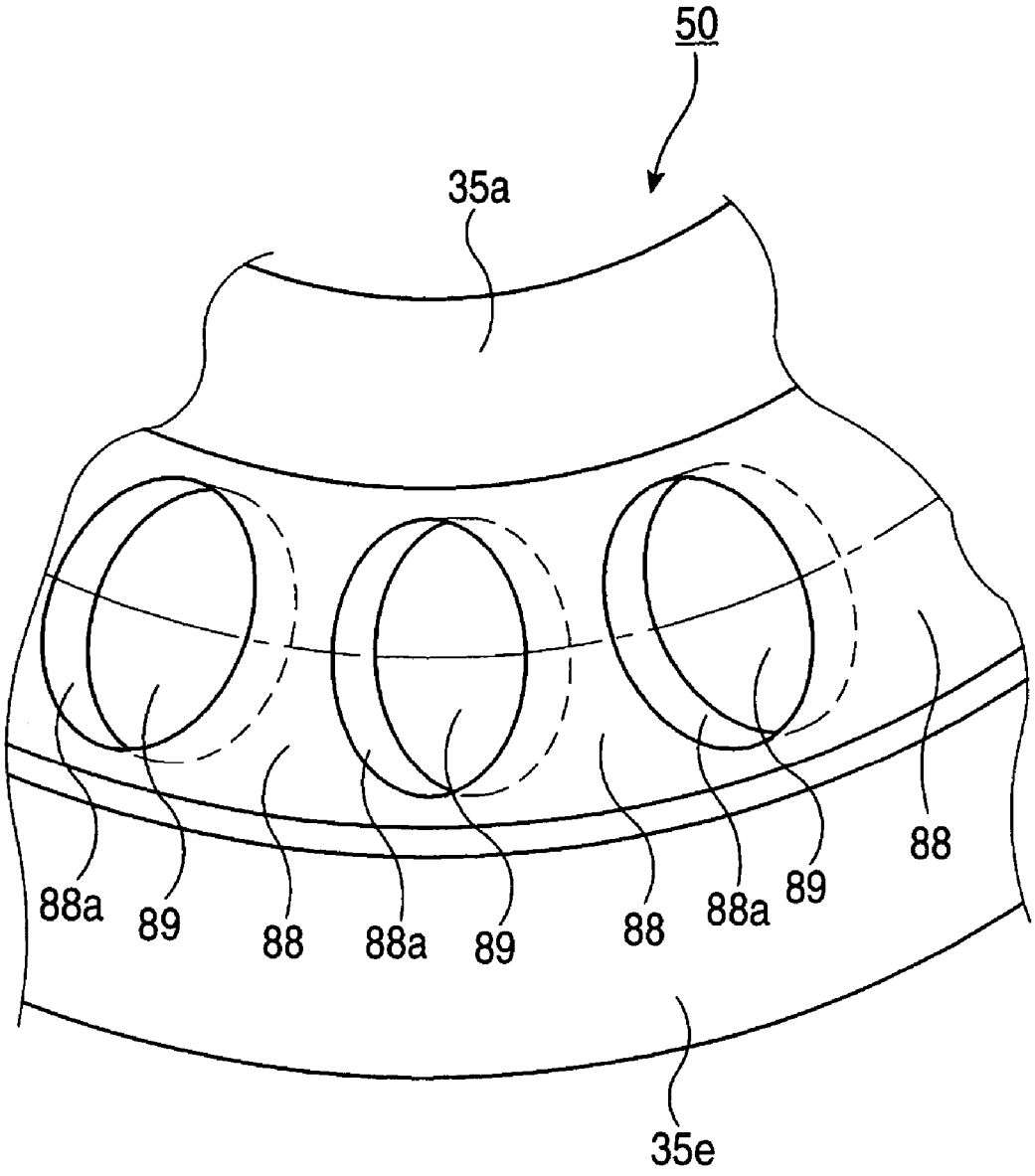
FIG. 8 is a partial perspective view of a main portion of a speaker apparatus according to a third embodiment of the invention.

FIG. 8 is a perspective view of a main portion of a speaker apparatus according to a third embodiment.

According to a speaker apparatus 50, as shown by FIG. 8, a shape of an opening 89 formed between connecting portions 88 is configured by an elliptical curved shape having an inclined face 88*a* in the speaker apparatus 30 of Example 1 shown by FIG. 2 and FIG. 3. Also in the constitution of the connecting portion 88 and the opening 89, not only an effect similar to those of the above-described embodiments is achieved but also, when the opening 89 is configured by the curved shape, there is not an acute angle portion in the connecting portion 88 and therefore, a portion on which an inner stress produced by an external force is concentrated can be avoided and a strength thereof can be increased. Further, the magnet circuit 33 can be held further solidly.

Further, although the elliptical shape is shown as the curved shape of the opening 89, the curved shape is not particularly limited so far as the curved shape is a curved shape which is not provided with an acute angle portion of a circular shape or the like.

Further, the connecting portion and the shape of the opening are not limited by the above-described shapes of the respective embodiments but can pertinently be changed in accordance with the scope of the invention. For example, in the speaker apparatus according to the above-embodiments, the angle of inclination $\alpha$ and the angle of inclination $\beta$ as well as the size and the shape of the opening or the like of the connecting portion are not limited by a structure formed by a plurality of pieces of same structures but there can also be constructed a constitution in which one speaker apparatus is provided with different connecting portions and openings.

A direction of the air flow can be controlled as desired by the different connecting portions and openings, an optimum structure can be set in consideration of a structure of a cabinet, an environment of arranging a speaker apparatus and the like, and a general purpose speaker apparatus having a wide range of an installing atmosphere can be provided.

As described above in details, the speaker apparatus 30 (40, 50) according to the embodiments is the speaker apparatus 30 (40, 50) including the magnetic circuit 33, the vibrating plate 41 and the drive cone 42 vibrated by the magnetic circuit 33, the speaker frame 35 for holding the magnetic circuit 33 and the vibrating plate, and the connecting portion 23 (78, 88) for connecting the portion of holding the vibrating plate 41 and the drive cone 42 and the portion of holding the magnetic circuit 33, the connecting portion 23 (78, 88) includes the inclined face 23*a* (78*a*, 88*a*) having the angle of inclination relative to the tangential line direction of the circumference of the speaker frame 35 and is constituted such that the air flow by the vibrating plate 41 and the drive cone 42 flows along the inclined face.

Thereby, the movement of the air flow by the back pressure in driving the vibrating plate 41 and the drive cone 42 can be made to be smooth, and a deterioration in sound quality of the speaker apparatus 30 (40, 50) can be prevented. Further, by making the movement of the air flow smooth, heat generated by the magnetic circuit 33 can efficiently be exhausted and therefore, the effect of cooling the magnetic circuit 33 can be promoted.

What is claimed:

1. A speaker apparatus comprising:

a driving member and a vibrating plate which are coaxially disposed along a direction of driving a magnetic circuit;

a frame including: a bottom plate portion holding the magnetic circuit; and a peripheral wall portion holding the vibrating plate and the driving member, wherein:

the vibrating plate and the driving member are fixed to the peripheral wall portion of the frame at an outer peripheral portion thereof;

an inner peripheral portion of the vibrating plate is bonded to the driving member, and an inner peripheral portion of the driving member is fixed to a voice coil bobbin;

a space surrounded by the vibrating plate and the drive member and the frame is hermetically closed;

a vibrating system is supported through the voice coil bobbin by a spring performance of a gas inside of the space;

the bottom plate portion and the peripheral wall portion are connected by a plurality of connecting portions, each of which has a plate shape, arranged spirally; and the plurality of connecting portions are disposed so that interspaces between each of the plurality of connecting portions define openings the plurality of connecting portions are configured to flow air due to a vibration of the vibrating plate along the inclined face thereof.

2. The speaker apparatus according to claim 1, wherein:

the bottom plate portion is vertically-disposed to a sound-radiation direction of the speaker apparatus;

the peripheral wall portion is disposed in parallel with the sound-radiation direction of the speaker apparatus; and ends of the plurality of connecting portions connecting with the peripheral wall portion are disposed at a front side of the sound-radiation direction compared to ends of the plurality of connecting portions connecting with the bottom plate portion.

3. The speaker apparatus according to claim 1, wherein:

a width of each of the plurality of connecting portions is gradually narrowed; and a bottom face of each of the plurality of connecting portions is a convex toward the sound-radiation direction.

4. The speaker apparatus according to claim 1, wherein in a cross sectional face of each of the plurality of connecting portions, the connecting portion has such a substantially wedge-like shape that the connecting portion is thin-walled at a side proximate to the peripheral wall portion.

5. The speaker apparatus according to claim 1, wherein in a cross sectional face of each of the plurality of connecting portions, the connecting portion has such a substantially stream shape that a center portion of the connecting portion is thick-walled and both end sides of the connecting portion are thin-walled.

6. The speaker apparatus according to claim 1, wherein a width of each of the openings is gradually broadened in a direction from the peripheral wall portion to the bottom plate portion.

* * * * *